United States Patent [19]

Heiman

[11] Patent Number: 4,690,368

[45] Date of Patent: Sep. 1, 1987

[54] APPARATUS FOR HOLLOW CONCRETE WALL CONSTRUCTION

[76] Inventor: Naftali Heiman, 105a Yehuda Halevi Street, Tel-Aviv, Israel

[21] Appl. No.: 723,833

[22] Filed: Apr. 16, 1985

[51] Int. Cl.[4] ..... E04G 11/08

[52] U.S. Cl. ..... 249/37; 249/38; 249/39; 249/79; 249/113; 249/141; 249/145; 249/175; 264/86; 425/84

[58] Field of Search ..... 249/36, 37, 40, 83, 249/97, 113, 141, 145, 175, 39, 79; 425/84, 85; 264/86, 87, 101

[56] References Cited

U.S. PATENT DOCUMENTS

| | | | |
|---|---|---|---|
| 1,989,409 | 1/1935 | Gordon | 264/87 |
| 2,111,562 | 3/1938 | Hughson | 249/36 |
| 2,361,933 | 11/1944 | Ferla | 425/84 |
| 2,533,263 | 12/1950 | Johnson | 425/85 |
| 2,585,756 | 2/1952 | Eschenbrenner | 425/85 |
| 3,530,555 | 9/1970 | Walker et al. | 425/84 |
| 3,809,513 | 5/1974 | Sellers et al. | 425/84 |
| 4,076,474 | 2/1978 | Catenacci | 425/84 |
| 4,291,064 | 9/1981 | Retzlaff | 425/84 |

FOREIGN PATENT DOCUMENTS

| | | | |
|---|---|---|---|
| 162644 | 2/1953 | Australia | 425/85 |
| 2607212 | 9/1976 | Fed. Rep. of Germany | 249/37 |
| 200610 | 5/1983 | German Democratic Rep. | 425/85 |
| 149538 | 8/1920 | United Kingdom | 249/37 |
| 545735 | 3/1977 | U.S.S.R. | 425/85 |
| 624791 | 9/1978 | U.S.S.R. | 425/84 |

*Primary Examiner*—Jay H. Woo
*Assistant Examiner*—James C. Housel
*Attorney, Agent, or Firm*—Benjamin J. Barish

[57] ABSTRACT

A spacer core for use in constructing hollow concrete walls by introducing the core between and spaced from a pair of vertical mold plates before casting the wet concrete, and subsequently removing the spacer core, the lower end of the spacer core including a water permeable wall and a bottom chamber for accumulating water permeating the wall. Also described is a method of constructing hollow concrete walls by the use of the above spacer core by: introducing the spacer core between and spaced from a pair of vertical mold plates; casting wet concrete into the spaces between the spacer core and the mold plates, whereby the water from the concrete permeates through the bottom of the spacer core into the bottom chamber; after a first time interval, lifting the spacer core a first predetermined distance to draw water from the concrete into the bottom chamber; and subsequently removing the spacer core from the concrete.

9 Claims, 13 Drawing Figures

APPARATUS FOR HOLLOW CONCRETE WALL CONSTRUCTION

BACKGROUND OF THE INVENTION

The present invention relates to spacer cores, such as are used in constructing hollow concrete walls. The invention also relates to a method of using such spacer cores for constructing hollow concrete walls and also to hollow concrete walls constructed according to such method.

A number of techniques have been devised for constructing hollow concrete walls, but efforts are continuously being made to improve these techniques. One of the problems in making such hollow concrete walls is the removal of the spacer core; thus, it cannot be removed until the concrete has sufficiently set to retain its form, but if the spacer core is retained too long within the concrete, the concrete will adhere to it so as to make the removal of the core very difficult or impossible.

An object of the present invention is to provide an improved technique having a number of advantages in the above respects, as will be described more particularly below, which improved technique involves a novel spacer core structure and also a novel method of using such a spacer core for constructing hollow concrete walls. A further object of the invention is to provide a concrete wall constructed in accordance with the novel method and using the novel spacer cores.

BRIEF SUMMARY OF THE INVENTION

According to one aspect of the present invention, therefore, there is provided a spacer core for use in constructing hollow concrete walls by introducing the core from its lower end between and spaced from a pair of vertical mold plates before casting the wet concrete, and subsequently removing the spacer core, characterized in that the spacer core has a width of at least an order of magnitude greater than its thickness, and in that the lower end of the spacer core includes a water permeable wall and a bottom chamber for accumulating water permeating the wall.

According to important preferred features of construction of the novel spacer core, its lower end includes side walls open at the bottom and covered with a strainer material to permit only the water to pass therethrough into the bottom chamber while blocking the flow therethrough of solid particles. In the described preferred embodiment, the side walls of the spacer core are formed with openings, and the strainer material includes an outer layer of a metal mesh overlying the cloth layer, the openings in the side walls, and the open bottom. The strainer material is releasably carried therefrom and to be retained embedded in the concrete when the spacer core is removed from the mold.

According to another aspect of the present invention, there is provided a method of constructing hollow concrete walls by the use of the above-described spacer core, comprising the steps: introducing the spacer core between and spaced from a pair of vertical mold plates; casting wet concrete in the spaces between the spacer core and mold plates, whereby the water from the concrete permeates through the bottom of the spacer core into the bottom chamber thereof; after a first-time interval, lifting the spacer core a first predetermined distance to draw water from the concrete into the bottom chamber; and subsequently removing the spacer core from the concrete.

As described below with respect to the illustrated preferred embodiment, the lifting of the spacer core the first-mentioned predetermined distance following the first-time interval (with strainer material maintained embedded in the core), provides a number of advantages. First, it creates a suction drawing water from the concrete into the bottom chamber, thereby speeding-up the setting of the concrete. In addition, it loosens the spacer core from the concrete, facilitating the subsequent removal of the spacer core after the concrete has sufficiently set to permit this.

According to a further feature in the described preferred embodiment, after the spacer core has been lifted the first predetermined distance following the first-time interval, it is retained in the concrete for a second-time interval following which it is lifted a second predetermined distance before it is subsequently removed from the concrete. This further loosens the spacer core from the concrete, better facilitating its subsequent removal.

According to a still further feature, during the lifting of the spacer core the first predetermined distance following the first-time interval, the bottom chamber is blocked from communication with the atmosphere, and during the lifting of the spacer core, the second predetermined distance following the second-time interval, the bottom chamber is vented to the atmosphere. This further facilitates the removal of the spacer core.

According to a still further aspect of the present invention, there is a concrete wall including, a vapor barrier of plastic sheet material lining at least one side of said insulation-filled section of the concrete wall.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
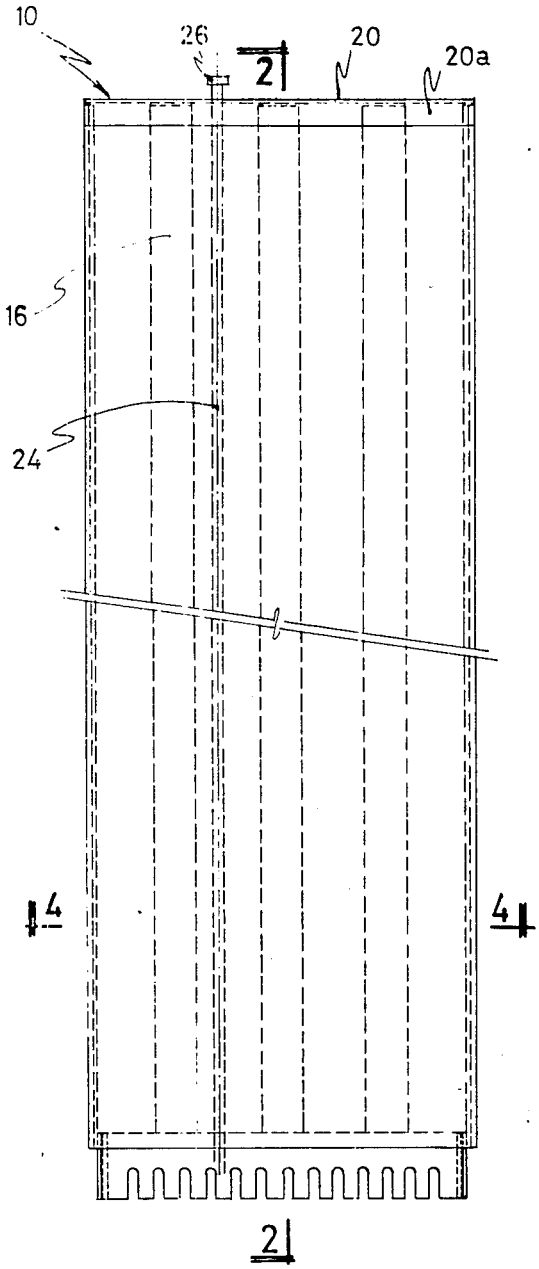
FIG. 1 is a front plan view illustrating one form of spacer core constructed in accordance with the present invention.
Figure 2:
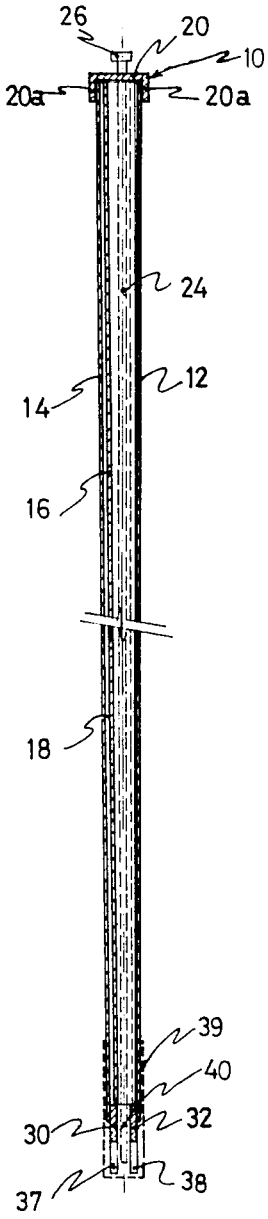
FIG. 2 is a longitudinal sectional view along lines II—II of FIG. 1.

The spacer core illustrated in FIGS. 1–4 and 4*a* is intended to be used with a pair of vertical mold plates for constructing hollow concrete walls. This use of the spacer core is more particularly illustrated in FIGS. 5*a*–5*e*, wherein it will be seen that the spacer core, therein generally designated 10, is disposed between and spaced from two vertical mold plates 2 and 4 defining spaces 6 and 8 therebetween to be filled with wet concrete. After the concrete has sufficiently set, the spacer core 10 is removed, thereby providing the hollow concrete wall. The concrete wall is subsequently filled with thermal insulation.

As indicated earlier, one of the problems in making such hollow concrete walls is the removal of the spacer core, since if it is removed too soon, the concrete will not have set sufficiently to retain its shape, whereas if it is removed too late, the concrete will have adhered to the spacer core so as to make its removal very difficult or impossible. The spacer core illustrated in FIGS. 1–4 and 4*a* of the drawings, and the method of using it for constructing hollow concrete walls as illustrated in FIGS. 5*a*–5*e* of the drawings, are particularly addressed to this problem of facilitating the removal of the spacer core 10.

As shown in FIGS. 1–4, spacer core 10 is of a hollow, metal, tapered construction, of slightly larger thickness at the top decreasing in thickness from its top to its bottom. The core includes a first panel 12 whose outer face defines one planar face of the core, and a second panel 14 whose outer face defines the opposite planar face of the core. The core further includes a plurality of vertically-extending, longitudinally-spaced hollow metal profiles 16 (FIGS. 4, 4*a*), each having a pair of parallel legs 16*a*, 16*b*, and a bridging web 16*c*. The two legs 16*a*, 16*b*, are secured, as by welding, to panel 14; and resilient elements 18, such as strips of natural or synthetic rubber, are interposed between webs 16*c* and the inner face of panel 12. The ends of the two panels 12 and 14 are formed with flanges 12*a* and 14*a*, secured together as by welding.

The upper end of the spacer core is closed by an end wall 20 (FIGS. 1 and 2), having depending flanges 20*a* secured to the metal panels 12 and 14, respectively. However, the lower end of the spacer core is not closed by a corresponding end wall, but rather is open, as will be more particularly described below. The upper end wall 20 may include a handle (not shown) facilitating the handling of the core. It further includes a pipe 24 extending for substantially the complete length of the core, the upper end of the pipe being closed by a removable cap 26. The purpose of pipe 24 and its cap 26 will be described more particularly below.

As indicated earlier, the two outside panels 12, 14 are not joined together at the bottom, but rather are open at the bottom.

Figure 3:
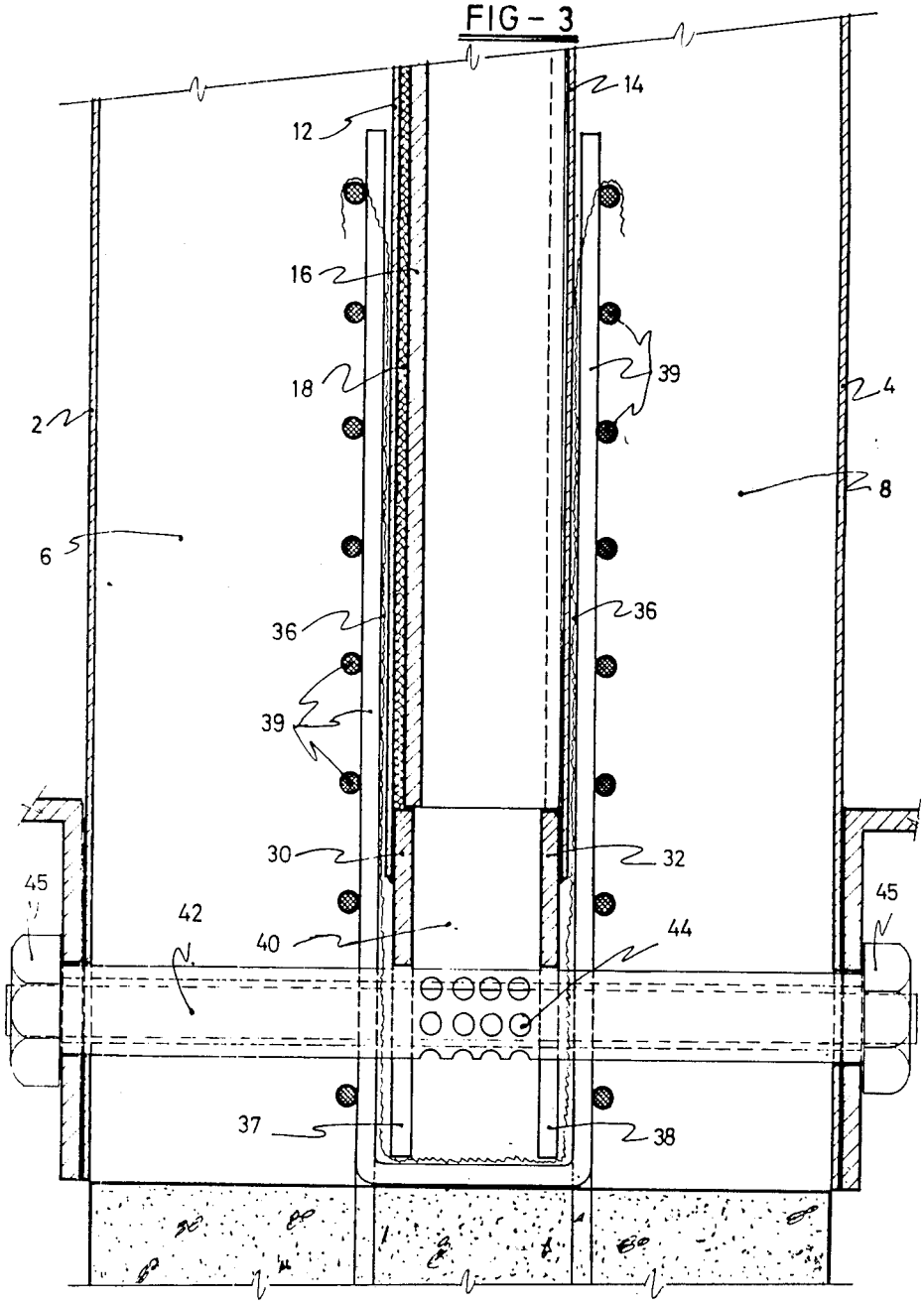
FIG. 3 is an enlarged fragmentary view of the lower end of the spacer core illustrated in FIG. 2 and the lower end of the vertical mold plates within which it is disposed.
Figure 4:
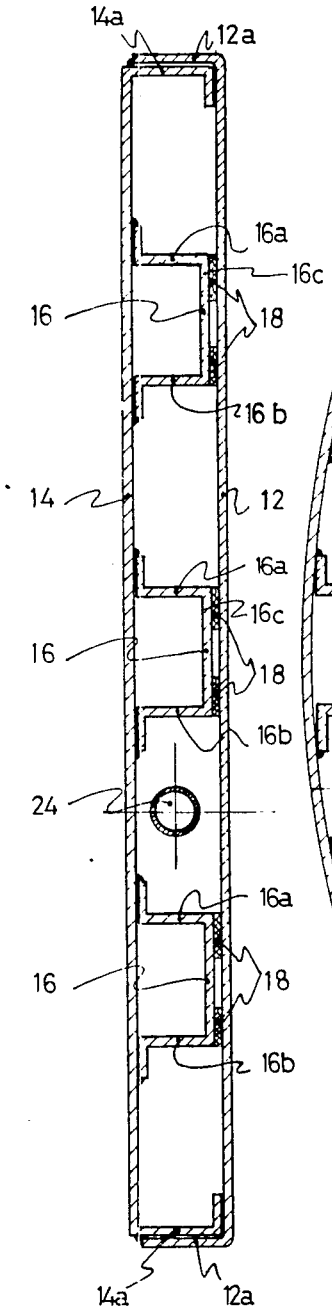
FIG. 4 is a transverse sectional view along lines IV—IV of FIG. 1.

The bottom structure of the spacer core 10 is more particularly illustrated in FIG. 3, wherein it will be seen that a pair of metal strips 30, 32 are secured, in any suitable manner such as by welding, to the bottom of the outside panels 12, 14, to project below them. The spacer core is closed at the bottom by a sheet of fabric 36 applied to the opposite faces of the bottom portions of panels 12, 14, and extension strips 30, 32. The lower ends of extension strips 30, 32, are formed with a plurality of horizontally-spaced vertically-extending slots 37, 38, starting from points about midway of the height of the extension strips and continuing to their bottom edges.

A fabric sheet 36, and a metal screen 39, are releasably applied to the open bottom of the spacer core so as to enclose the bottom portions of panels 12, 14, and also their extensions 30, 32, thereby defining a chamber 40 at the bottom of the spacer core having water-permeable walls.

The metal screen 38 may be a wire mesh; alternatively, it could be expanded metal. The fabric sheet 36 may be applied over the open bottom of the extension strips 30, 32 and its opposite ends merely draped over the upper ends of the metal screen 39. Both the fabric sheet 36 and the metal screen 38 are releasably retained, in any suitable manner, such as by their own friction, to the bottom of the spacer core since they separate from the spacer core when the latter is removed from the mold, and remain embedded in the cast concrete.

The concrete poured into spaces 6 and 8 on opposite sides of core 10 between the core and the mold plates 2 and 4 preferably has a higher percentage of water than the normal concrete mix. This permits the concrete to obtain a better facing and to more completely fill the spaces between the mold plates and the spacer core. As will be described below, a substantial quantity of the water in the concrete mix passes through the metal screen 39 and the fabric sheet 36 into chamber 40 at the bottom of spacer core 10. A pipe 42 is attached by removable end pins 45 to the vertical mold plates 2, 4, and extends through slots 37, 38 into chamber 40 at the bottom of the spacer core. Drainpipe 42 is formed with openings 44 within chamber 40 to provide a passageway for the water accumulating within that chamber to flow out of that chamber through the pipe. Drainpipe 42, which is preferably of hard plastic material, also braces the mold plates during the pouring of the concrete into the spaces 6, 8 on opposite sides of the spacer core. This pipe remains embedded in the cast concrete, and therefore its end pins 43 are removed to permit the cast concrete to be removed from the mold. If desired, a plurality of such drainpipes may be provided, each received in aligned slots in the extension strips 30, 32.

Vertical pipe 24 disposed within the spacer core 10 extends into chamber 40 at the bottom of the core. As will be described below, pipe 24 serves to selectively vent chamber 34 to the atmosphere (when its cap 26 is removed). Vertical pipe 24 may also be used for applying hot air to the spacer core 10 in order to accelerate the drying of the concrete.

When casting a vertical wall between mold plates 2, 4, a plurality of cores 10 would be used in side-by-side relationship with a sinuously configured metal reinforcing rod 50 interposed between each pair of adjacent cores. This is more particularly illustrated in FIGS. 4*a* and 5*a*–5*e*, wherein it will be seen that the sinuously-configured metal rods 50 project past the opposite faces of the line of cores 10 so as to be embedded in the concrete poured into the spaces 6, 8 between the cores and the mold plates 2, 4. These rods 50 serve to join and reinforce the two sides of the hollow concrete wall after removal of the spacers from the mold.

Figure 5A:
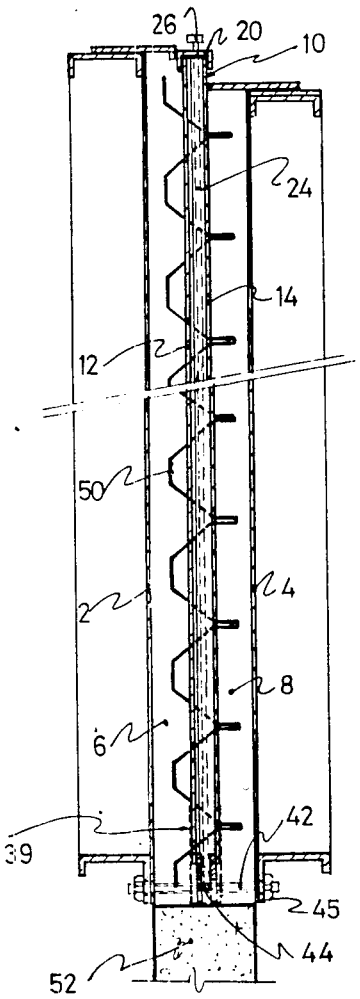
FIGS. 5*a*–5*e* are views showing the positions of a plurality of the spacer cores in the vertical mold during the various stages of constructing a hollow concrete wall.
Figure 7:
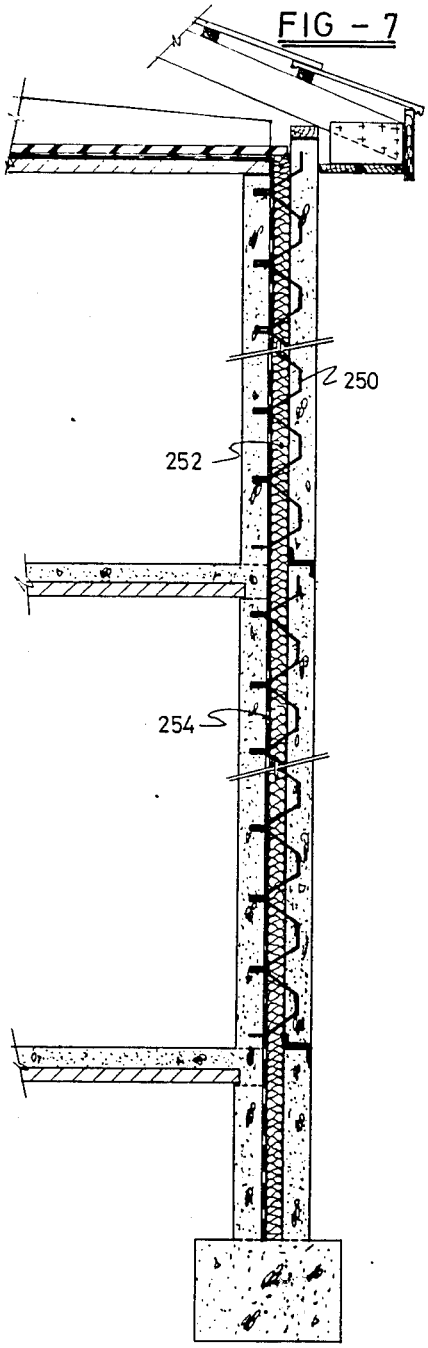
FIG. 7 is a vertical section of a portion of a building structure constructed with hollow concrete walls made in accordance with the present invention.

Reference is now made to FIGS. 5*a*–5*e*, illustrating the various stages in the construction of a hollow concrete wall using the space cores 10 of FIGS. 1–4 and 4*a*;

FIG. 5*a* illustrates the first stage, wherein the spacer cores 10 have been introduced into the mold between the two vertical mold plates 2, 4, and spaced from those mold plates so as to provide the spaces 6, 8 to receive the cast concrete. The hollow wall is to be cast on top of an underlying wall 52. The inner side of the upper end of the wall to be cast is stepped below the outer side to provide a support for a floor or ceiling, as shown in FIG. 7. The width of the wall to be cast may be 2.5–3 m. The width of each spacer core 10 may be about 580 cm., so that six such spacer cores may be used in side-by-side relationship spaced from each other only by the thickness of the sinuous reinforcing rods 50; this permits the concrete to flow into these spaces and to embed the reinforcing rods 50 to produce an integrated hollow wall structure.

Figure 5B:
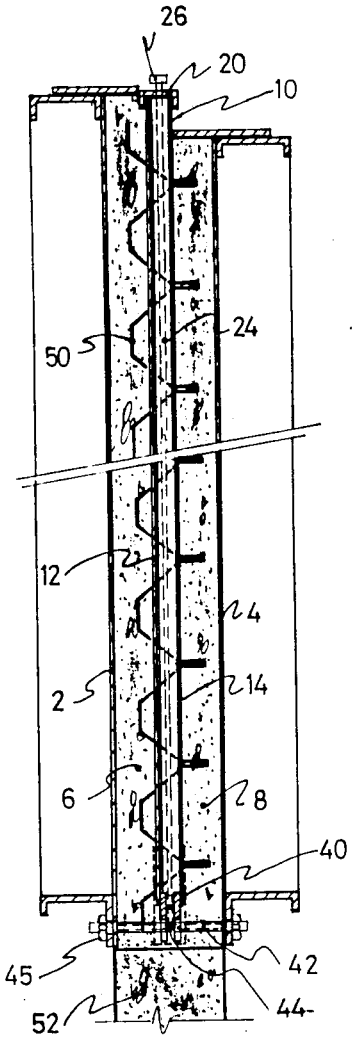

FIG. 5*b* illustrates the stage wherein the wet concrete has been cast in the spaces 6 and 8 between the spacer cores 10 and the vertical mold plates 2 and 4. The concrete is preferably cast with an excess of water as mentioned above, and is vibrated to facilitate settling of the water in the bottom of a mold. This water can seep through the metal screen 39 and the fabric sheet 36 at the bottom of the spacer cores 10 to enter chamber 40 via the open bottom of the cores and openings 37, 38 through the sides of the cores. Fabric layer 36 acts as a strainer to permit only the water to enter chamber 40, blocking the passage of solid particles.

Figure 5C:
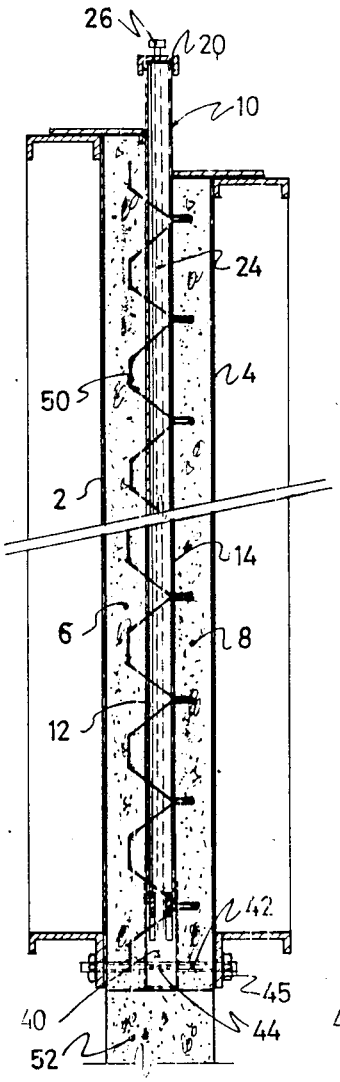
Figure 5D:
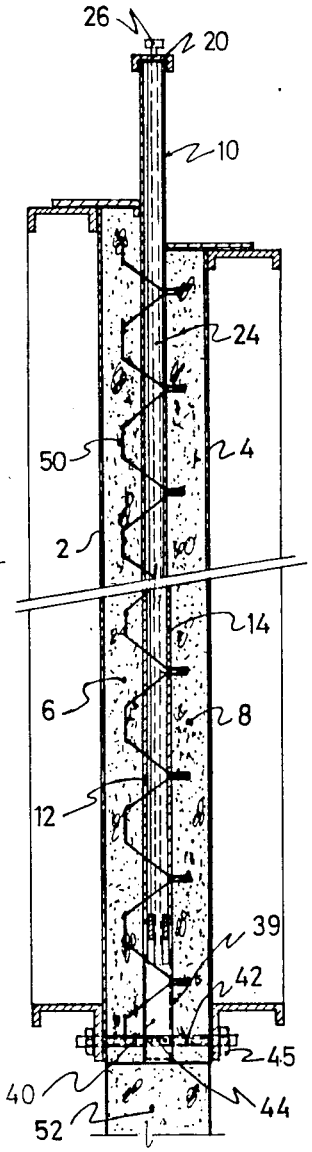

After a predetermined time interval, approximately 2–40 minutes, preferably about 30 minutes, spacer cores 10 are lifted a predetermined distance, which may be 10–20 cm., preferably about 15 cm. This is the condition illustrated in FIG. 5*c*. The lifting of the spacer cores 10 is effected by any suitable means. During this lifting of the cores, the upper end of pipe 24 is closed by cap 26 so that a vacuum is created which draws more water from the concrete into the bottom chamber 40; this water is also strained by the fabric layer 36. As illustrated in FIG. 5*c*, the fabric layer 36 and metal screen 39 do not move upwardly with the spacer cores 10, but rather remain in their initial positions embedded in the concrete.

After an additional predetermined time interval, for example from 50–70 minutes, preferably about 60 minutes, the spacer cores 10 are lifted an additional distance (FIG. 5*d*), for example 10–40 cm., preferably about 30 cm. This step is preferably performed after cap 26 at the upper end of pipe 24 has been removed so as to vent chamber 40 to the atmosphere.

Figure 5E:
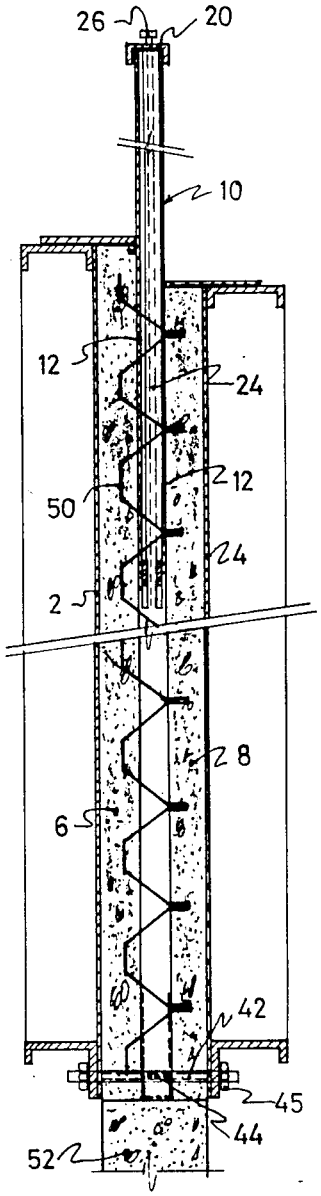

The spacer cores 10 are retained in this position for a further time interval, for example from 10–120 minutes, preferably about one hour, whereupon they are lifted a further distance, for example 100–150 cm., preferably about 125 cm.; they are retained in this position for an additional time period sufficient for the concrete to set to permit the complete removal of the cores. This condition is illustrated in FIG. 5*e*.

The spacer cores 10 may then be removed at any convenient time after the setting of the concrete, for example the next day or so.

During all the foregoing stages, particularly the first stages, the water settling within chamber 40 is able to flow out of the chamber via drainpipe 42, the water entering the pipe through its openings 44 and leaving the pipe at its open ends, which have been detached from the bottom of the two vertical mold plages 2, 4 by the removal of the end pins 43.

Figure 6:
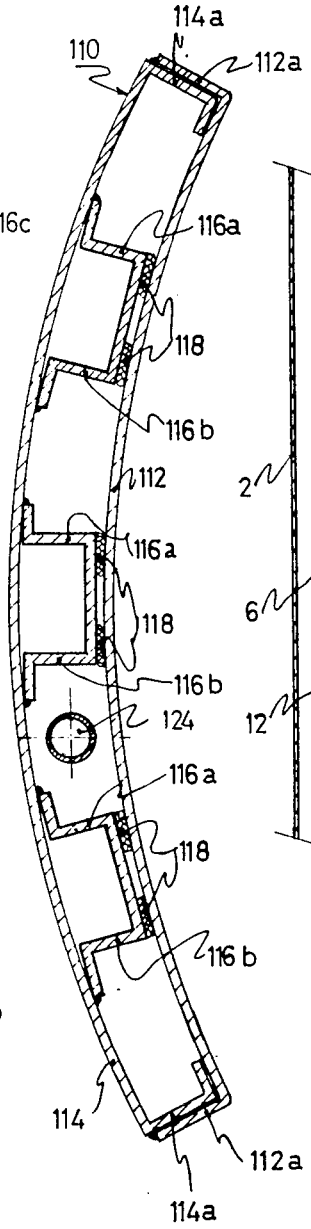
FIG. 6 is a transverse sectional view, corresponding to that of FIG. 4, but illustrating the configuration of a spacer core for use in constructing curved concrete walls.
Figure 4A:
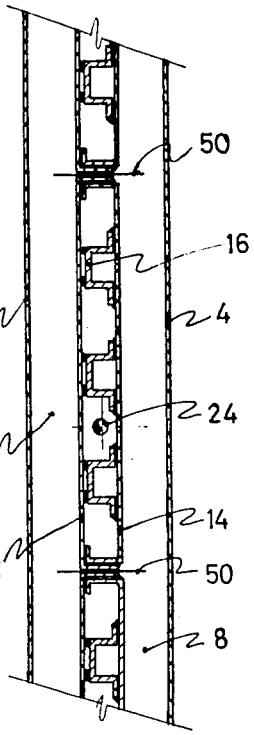
FIG. 4*a* is a fragmentary transverse sectional view illustrating a plurality of spacer cores according to FIGS. 1–4 between a pair of vertical mold plates for constructing a hollow concrete wall.

It will be appreciated that the spacer cores 10 may take any configuration, according to the desired configuration of the wall to be cast. FIG. 6 illustrates a spacer core 110 of curved configuration for casting a curved, hollow, vertical wall. This spacer core is of the same construction as described above, including the two panels 112, 114, spaced by channel legs 116*a*, 116*b*, except that the panel members 112, 114 are of curved configuration rather than of planar or flat configuration.

FIG. 7 is a vertical section through a portion of the building structure wherein the external walls are made in the manner described above. Thus, the vertical walls are cast so as to form the hollow construction as described above, including the sinuous reinforcing rods 250 between the ends of adjacent spacer cores such that these reinforcing rods are embedded in the cast concrete on both sides of the hollow space void of conrete produced by the spacer cores. This hollow space is filled with insulation, as shown at 252.

This technique also permits the introduction of a vapor barrier into the hollow concrete wall, by merely applying the vapor barrier material, such as polyethylene sheets, on one side or both sides of the spacer cores before the concrete is poured. This vapor barrier may be retained by the reinforcing rods 250 so that the vapor barrier would be embedded in the concrete lining the respective side of the hollow space formed upon removal of the spacer cores. FIG. 7 illustrates such a vapor barrier 254 lining the inner face of the cast concrete facing the space void of concrete which is subsequently filled with the insulation 252.

Figure 8:
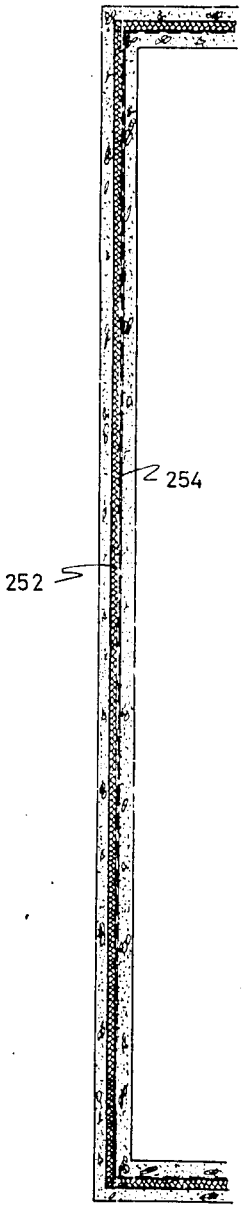
FIG. 8 is a horizontal section of a portion of the building structure of FIG. 7.

The vertical section of FIG. 7, and also the horizontal section of FIG. 8, thus illustrate that the technique of the present invention is capable of producing hollow concrete walls to include a substantially continuous thermal insulation (252), and a substantially continuous vapor barrier (254), between the inner and outer concrete faces of the wall with substantially no thermal or vapor bridge between them, except for the sinuous reinforcing rods 250 which are embedded to extend transversely and embedded in the concrete wall.

It will be appreciated that the novel spacer core structure and the novel method of using it for constructing hollow concrete walls, provide a number of important advantages. Thus, the provision of the bottom chamber (40) for accumulating the water, and also the lifting of the core the first predetermined distance after the first short time interval, facilitate the removal of the water from the concrete, and thereby decreases the time for it to set sufficiently so as to enable removing the spacer core. This first stage lifting of the spacer core also loosens it from the setting concrete, thereby facilitating its removal. In addition, pipe 24 may be used not only for selectively disconnecting chamber 40 from the atmosphere to produce suction for drawing more water into the chamber, but also for applying hot air to the spacer core and to the cast concrete should it be desired to speed-up the water removal and setting of the concrete. Pipe 24 may also be used for removing the water from chamber 40.

It will be appreciated that the described embodiments of the invention are set forth for purposes of illustration only, and that many other variations, modifications, and applications of the invention may be made.

What is claimed is:

1. Apparatus for use in constructing hollow concrete walls including a pair of vertical mold plates; a spacer core to be introduced from the lower end of the core and spaced from the pair of vertical mold plates before casting wet concrete, and to be subsequently removed after initial setting of the concrete, said spacer core having a width of at least an order of magnitude greater than its thickness, only the lower end of said spacer core including a water permeable wall and a bottom chamber for accumulating water permeating said wall; and means for spacing the spacer core from the vertical mold plates when introduced therebetween.

2. The apparatus according to claim 1, wherein said spacer core includes flat side walls and decreases in thickness from top to bottom, said side walls being open at the bottom only and covered with a strainer material to permit only the water to pass therethrough into said bottom chamber while blocking the flow therethrough of solid particles.

3. The apparatus according to claim 2, wherein said side walls are formed at their bottoms with openings therethrough, and said strainer material includes a cloth layer covering the openings through said side walls and said open bottom.

4. The apparatus according to claim 3, wherein said strainer material further includes an outer layer of a metal screen overlying said cloth layer, the openings through said side walls, and said open bottom.

5. The apparatus according to claim 2, wherein said strainer material is releasably carried by the bottom of said spacer core so as to be released therefrom, and to be retained embedded in the concrete, when the spacer core is removed therefrom.

6. The apparatus according to claim 1, further including a drainpipe extending through said bottom chamber and having openings in the pipe for draining the water accumulating in the bottom chamber, said drainpipe engaging the mold plates to brace them when the mold is filled with concrete, and being detached from the spacer core so as not to be removed with the spacer core but to remain embedded in the concrete wall produced by the mold plates.

7. The apparatus according to claim 1, further including a pipe leading from the upper end of the spacer core and extending therethrough into said bottom chamber for selectively venting the chamber to the atmosphere when the core is removed and for applying hot air to the spacer core to accelerate the setting of the concrete.

8. The apparatus according to claim 1, wherein said spacer core is of hollow construction and includes a first panel defining one face of the core, a second panel defining the opposite face of the core, and a plurality of hollow profiles extending longitudinally between the first and second panels and spacing them apart.

9. The apparatus according to claim 8, further including resilient elements interposed between the hollow profile and said first panel.

* * * * *